US010071348B2

(12) United States Patent
Larsen

(10) Patent No.: US 10,071,348 B2
(45) Date of Patent: Sep. 11, 2018

(54) LIQUID PROCESSING MIXER

(71) Applicant: Tetra Laval Holdings & Finance S.A., Pully (CH)

(72) Inventor: Frederik Larsen, Dronninglund (DK)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 61 days.

(21) Appl. No.: 15/106,692

(22) PCT Filed: Dec. 16, 2014

(86) PCT No.: PCT/EP2014/077898
§ 371 (c)(1),
(2) Date: Jun. 20, 2016

(87) PCT Pub. No.: WO2015/091439
PCT Pub. Date: Jun. 25, 2015

(65) Prior Publication Data

US 2017/0021314 A1 Jan. 26, 2017

(30) Foreign Application Priority Data

Dec. 20, 2013 (SE) ..... 1351546

(51) Int. Cl.
*B01F 5/16* (2006.01)
*B01F 7/00* (2006.01)
(Continued)

(52) U.S. Cl.
CPC ..... *B01F 7/00775* (2013.01); *B01F 3/1221* (2013.01); *B01F 5/16* (2013.01);
(Continued)

(58) Field of Classification Search
USPC ..... 366/182.4
See application file for complete search history.

(56) References Cited

U.S. PATENT DOCUMENTS 6,843,886 B1 1/2005 Huovinen et al.

FOREIGN PATENT DOCUMENTS

| | | |
|---|---|---|
| GB | 1 437 427 A | 5/1976 |
| GB | 1 595 294 A | 8/1982 |
| WO | WO 01/38632 A1 | 5/2001 |

OTHER PUBLICATIONS

International Search Report (PCT/ISA/210) dated Mar. 6, 2015, by the Japanese Patent Office as the International Searching Authority for International Application No. PCT/EP2014/077898.
(Continued)

*Primary Examiner* — Mark Halpern
(74) *Attorney, Agent, or Firm* — Buchanan Ingersoll & Rooney PC

(57) ABSTRACT

A mixing unit for mixing a flow of liquid product is provided. The mixing unit comprises a stator forming a hollow sleeve, and a rotor having a circular displacement plate with two opposite sides, wherein at least one side has at least two chambers formed by a plurality of vanes extending in a direction being parallel with a longitudinal axis of the stator, wherein the rotor is arranged within the stator for rotating liquid product arranged in said chambers relative the stator. The displacement plate is tilted relative a longitudinal axis of the stator such that said at least two chambers have different volumes, and a side wall of the stator has at least one exit area comprising at least one through hole for allowing liquid product to exit the stator.

10 Claims, 4 Drawing Sheets

(51) Int. Cl.

| | |
|---|---|
| ***B01F 7/16*** | (2006.01) |
| ***B01F 3/12*** | (2006.01) |
| ***F04D 1/00*** | (2006.01) |
| ***B01F 15/02*** | (2006.01) |

(52) U.S. Cl.
CPC ..... *B01F 7/164* (2013.01); *B01F 15/026* (2013.01); *B01F 15/0258* (2013.01); *F04D 1/006* (2013.01); *B01F 2003/125* (2013.01); *B01F 2215/0014* (2013.01); *B01F 2215/0031* (2013.01); *B01F 2215/0032* (2013.01)

(56) References Cited

OTHER PUBLICATIONS

Written Opinion (PCT/ISA/237) dated Mar. 6, 2015, by the Japanese Patent Office as the International Searching Authority for International Application No. PCT/EP2014/077898.
Office Action dated May 21, 2014, by the Swedish Patent Office in corresponding Patent Application No. 1351546-5.

LIQUID PROCESSING MIXER

This application is a 371 of PCT/EP2014/077898 filed 16 Dec. 2014

TECHNICAL FIELD

The present invention relates to a mixing unit for mixing a flow of liquid product, e.g. with liquid, gaseous, and/or solid additives. More particularly, the present invention relates to a mixing unit for mixing hygienic substances, such as liquid food or cosmetics, as well as to a method for mixing such hygienic substances with various additives.

BACKGROUND

In liquid processing industry, such as food processing, mixers are widely used for providing an efficient mix of liquids with solid and/or gaseous contents. Within this technical field it is common to classify the available mixers into i) batch mixers or ii) inline mixers. Typically, a batch mixer operates by circulating the media to be mixed within a tank and it is often a preferred choice for high viscous fluids. Inline mixers are typically operating in a different manner, in which the fluids are circulated outside the tank for continuously mixing liquid. As compared with batch mixers, inline mixers are often preferred for low viscous liquids and for large volume production.

The pumping ability of existing in-line mixers and especially existing in-line high-shear mixers is significantly reduced when the liquid viscosity is increased. At viscosities above 1000 cP their pumping ability is often completely lost, in particular if their pump performance is based on the centrifugal principle. Today this limits the use of inline mixers to mixing applications for relatively low viscous fluids.

In liquid processing applications it is important to reduce the manufacturing costs for the liquid processing equipment. However, the process of mixing additives into liquids in an in-line mixer comes with a number of considerations which need to be dealt with. One requirement is the provision of a vacuum in order to suck in the additives into the liquid. It is also required to provide a mixer which allows pumping of liquids containing un-dissolved gases and powders. A yet further requirement is associated with high viscosity liquids since such liquids normally must be handled by complex and expensive positive displacement pumps. In addition to this, a liquid processing mixer should also be capable of providing a high shear mixing.

In view of this there is a need for an improved liquid processing mixer, which is capable of handling a wide range of liquid products. Such mixer should have a simple mechanical design and it should require a reduced physical footprint.

SUMMARY

It is, therefore, an object of the present invention to overcome or alleviate the above described problems.

The basic idea is to provide an in-line mixer having a single mixing unit which creates a suction pressure on the inlet side, and a pressure on the outlet side. Hence, a single mixing unit provides a high shear mixer with a self-inducing positive displacement pump.

According to a first aspect a mixing unit for mixing a flow of liquid product is provided. The mixing unit comprises a stator forming a hollow sleeve, and a rotor having a circular displacement plate with two opposite sides. At least one side has at least two chambers formed by a plurality of vanes extending in a direction being parallel with a longitudinal axis of the stator, wherein the rotor is arranged within the stator for rotating liquid product arranged in said chambers relative the stator. The displacement plate is tilted relative a longitudinal axis of the stator such that said at least two chambers have different volumes, and a side wall of the stator has at least one exit area comprising at least one through hole for allowing liquid product to exit the stator.

The mixing unit may further comprise an electrical motor, wherein a rotational axis of the motor is connected to the rotor of the mixing unit.

The plurality of vanes may form a vane assembly such that each vane extends radially outwards from a centre portion of the displacement plate, and such that the outer edges of the vane assembly are arranged adjacent to an inner surface of the stator for forming the chambers.

The at least one exit area may be arranged at a circumferential position corresponding to a position where the chambers have a decreasing volume.

Each one of said opposite sides of the displacement plate may have at least two chambers formed by a plurality of vanes.

A single vane assembly may form the chambers on both sides of the displacement plate.

The mixing unit may further comprise an inlet for allowing liquid product to enter at least one of said chambers, and an outlet for allowing liquid product to exit said mixing unit, wherein said inlet is arranged at a circumferential position corresponding to a position where the chambers have an increasing volume.

According to an embodiment, the mixing unit may further comprise an additional inlet for allowing liquid product to enter at least one of said chambers on an opposite side of the displacement plate.

The mixing unit may further comprise a first inlet for allowing liquid product to enter at least one of said chambers, a second inlet for allowing liquid product exiting the at least one chamber to enter at least one of the chambers on an opposite side of the displacement plate, and an outlet for allowing liquid product to exit said mixing unit.

According to a second aspect, a liquid processing mixer is provided. The liquid processing mixer comprises a flow of liquid product, at least one additive inlet for allowing additive content to be introduced into said flow of liquid product, and a mixing unit according to the first aspect for mixing said additive content into said flow of liquid product.

The liquid processing mixer may further comprise a sub-pressure zone provided upstream said mixing unit, and the liquid processing mixer may further comprise at least one additive inlet connected to said sub-pressure zone for introducing said additive upstream said mixing unit.

The liquid processing mixer may further comprise a throttle valve provided upstream of said mixing unit for creating said sub-pressure zone between said throttle valve and said mixing unit.

The liquid processing mixer may further comprise a pressure sensor for monitoring the pressure of said sub-pressure zone.

At least one of said additive inlets may be connected to a powder hopper.

Each one of said additive inlets may be controlled by means of a corresponding valve.

The liquid to be mixed may preferably be a hygienic liquid product, such as food, chemicals, pharmaceuticals, and/or cosmetics.

According to a third aspect, a method for mixing a flow of liquid product is provided. The method comprises the steps of introducing liquid product into at least one chamber of a rotor, which rotor is allowed to rotate within a stator, and which chamber is formed by at least two vanes extending in a direction being parallel with a longitudinal direction of the stator, wherein a normal direction of the displacement plate is tilted relative a longitudinal axis of the stator; rotating said rotor such that the volume of the at least one chamber is reduced, and discharging said liquid product by allowing the liquid product to exit said chamber through at least one hole being provided in a sidewall of said stator.

The method may further comprise the steps of introducing liquid product into at least one further chamber of the rotor, which chamber is formed by at least two vanes extending in a normal direction from an opposite side of the displacement plate, and discharging said liquid product by allowing the liquid product to exit said chamber through at least one hole being provided in an opposite sidewall of said stator.

BRIEF DESCRIPTION OF DRAWINGS

The above, as well as additional objects, features, and advantages of the present invention, will be better understood through the following illustrative and non-limiting detailed description of preferred embodiments of the present invention, with reference to the appended drawings, wherein.

DETAILED DESCRIPTION

Figure 1:
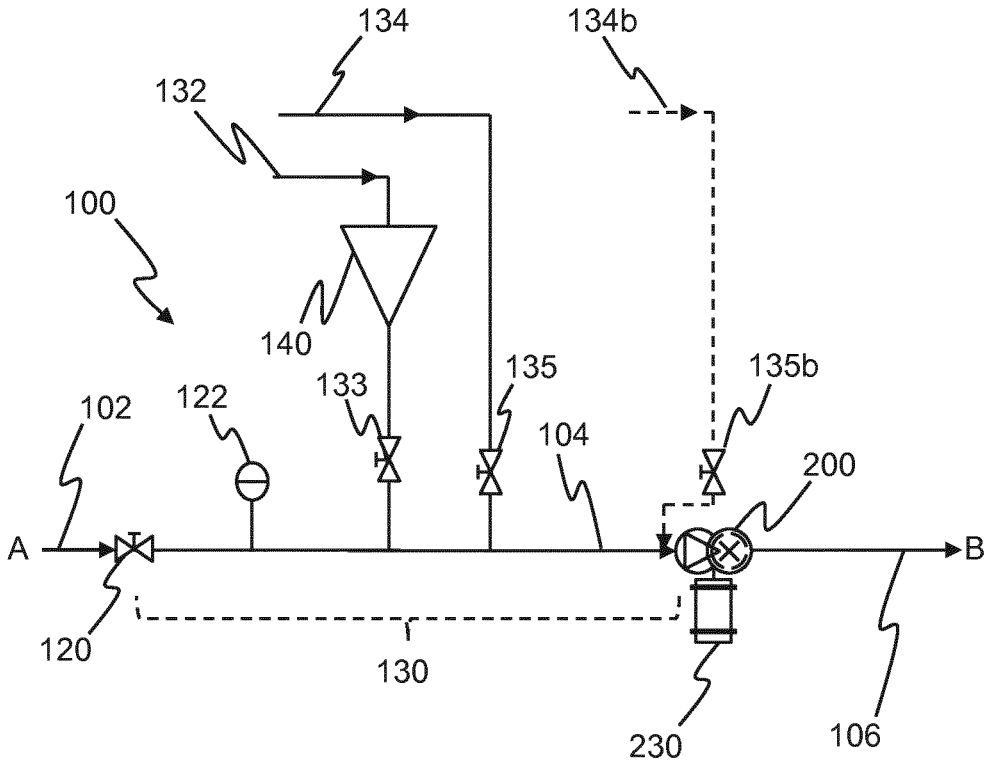
FIG. 1 is a schematic view of a liquid processing mixer according to an embodiment.

Starting with FIG. 1, a part of a liquid processing system is shown. The shown part may be included in a much larger processing system, including various liquid processing components such as heaters, homogenizers, separators, filters, etc in order to be able to completely, or partly, process a hygienic liquid product. An example of a liquid processing system for use with the present invention is a liquid food processing system, capable of treating various liquid food products such as milk, juices, still drinks, ice creams, yoghurts, etc. However, a liquid processing system for use with the present invention may also include a system for treating and processing chemical, pharmaceutical, and/or cosmetic liquids.

The shown part forms a liquid processing mixer 100 capable of mixing a flow of liquid product with an additive. The mixer 100 has an inlet 102, receiving liquid to be mixed from a batch tank, or any upstream processing equipment, as indicated by the reference "A". From the inlet 102 the liquid to be mixed is transported through a suitable conduit, such as tubes or piping 104, into a mixing unit 200 which will be further described below.

The mixing unit 200 may in some embodiments be configured to circulate liquid over a batch tank (not shown). In such embodiments the mixing unit 200 is preferably located close to the batch tank for eliminating the need for an inlet pump or outlet booster pump. Further, the liquid processing mixer 100 may include an outlet 106 for connecting the liquid processing mixer 100 with an inlet of the batch tank, as indicated by "B". In other embodiments the outlet 106 may be provided for connecting the liquid processing mixer 100 with other downstream processing equipment, such as storage, transport, heat treatment units, filling machines, or similar.

A throttle valve 120 is preferably used to create a sub-pressure zone or vacuum zone 130 upstream of the mixing unit 200, i.e. between said throttle valve 120 and the mixing unit 200. The actual vacuum level may be indicated by means of a pressure sensor 122, such as a manometer in fluid connection with the vacuum zone 130. Preferably, the throttle valve 120 is a seat or membrane valve being electronically or manually controlled.

The vacuum zone 130 includes at least one additive inlet 132, 134, for allowing the insertion of additional compounds in the liquid to be mixed. Additional compounds may for example involve solid powder representing particular flavours or other ingredients, as well as further liquids such as oils etc.

The ingredient inlets 132, 134 are preferably arranged in the vacuum zone 130, i.e. between the throttle valve 120 and the mixer unit 200.

Powder ingredients are preferably introduced a bit longer upstream than liquid ingredients since some spreading and pre-wetting of powders are beneficial for dispersing and dissolving while liquid ingredients are best introduced immediately before the mixing stage 200, especially in hot-cold emulsification processes. In specific embodiments the powder inlet 132 may be connected to a powder hopper 140, a big-bag station etc. or mounted with a hopper for manual de-bagging.

Each additive inlet 132, 134 is preferably arranged in fluid connection with a respective inlet valve 133, 135. The opening of the additive inlet valves 133, 135 may be set to control dosing rate and can be closed rapidly by the operator, e.g. in case a powder rat-hole is emerging.

In a yet further embodiment, an additive inlet **134*b* is provided which connects with an inlet of the mixing unit 200. This is indicated in FIG. 1, where a corresponding control valve 135*b* is provided to allow further ingredient addition via the inlet 134*b*. The additive inlet 134*b* may replace the previously described inlet 134, or it may be provided as an additional inlet. Preferably, the optional inlet 134*b*** is used for including further liquids, such as oil, into the main liquid to be processed.

The location of the powder additive inlet valve(s) 133 in-line with the liquid product stream makes back-flush, i.e. when liquid enters the dry phase, almost impossible and significantly reduce the risk of powder valve related production stops.

In fact, proof-of-concept tests have verified that that powder interface remain dry even if the powder introduction valves are defect and left partly opened.

Still referring to FIG. 1, the sub-pressure zone 130 may be provided by means of a de-aeration vessel (not shown) in fluid connection with the mixing unit 200.

The disclosed embodiments of a liquid processing mixer 100 may preferably also be equipped with a cleaning-in-place (CIP) system, capable of cleaning the components without dismounting the mixer 100.

In a further embodiment, the mixer 100 may be configured to circulate liquid product over the mixing unit 200. In such embodiment the mixer 100 consists of an inlet A, the mixing unit 200, and an outlet B. A valve (not shown) may be provided at the outlet B for returning some part of mixed liquid product back to inlet A. In a yet further embodiment, all mixed liquid product is fed back to inlet A such that the liquid product is again mixed by the mixing unit 200.

The mixing unit 200 provides a mechanical treatment of the liquid for mixing. A general explanation of the mixing unit 200 will be described with reference to FIGS. 2-6.

Figure 2:
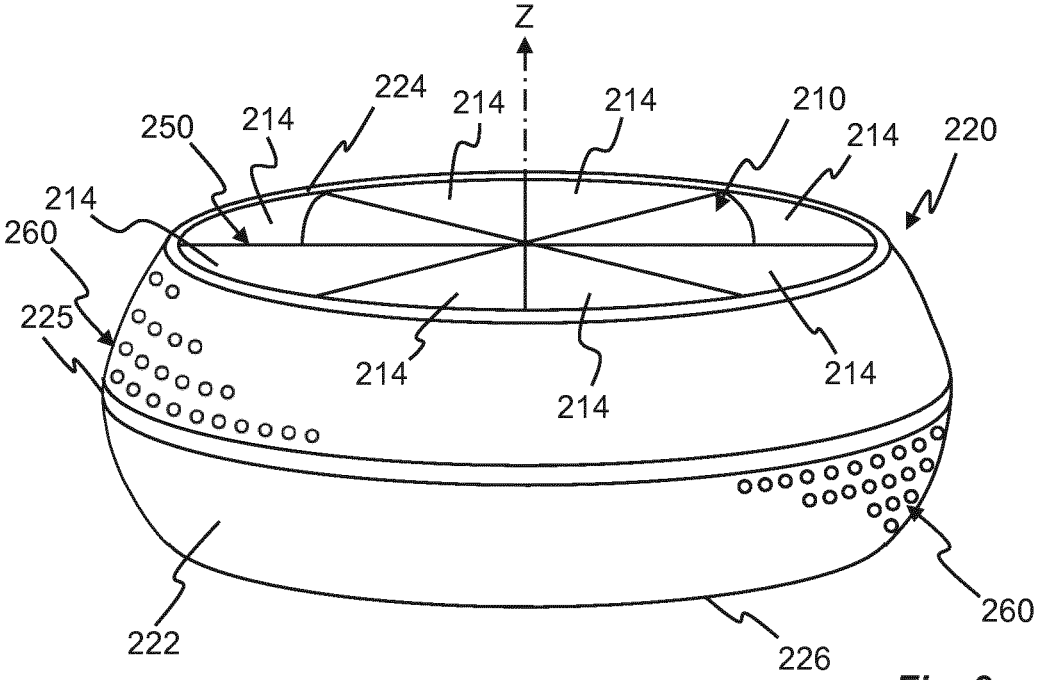
FIG. 2 is a perspective view of a stator of a mixing unit for use in a liquid processing mixer.
Figure 3:
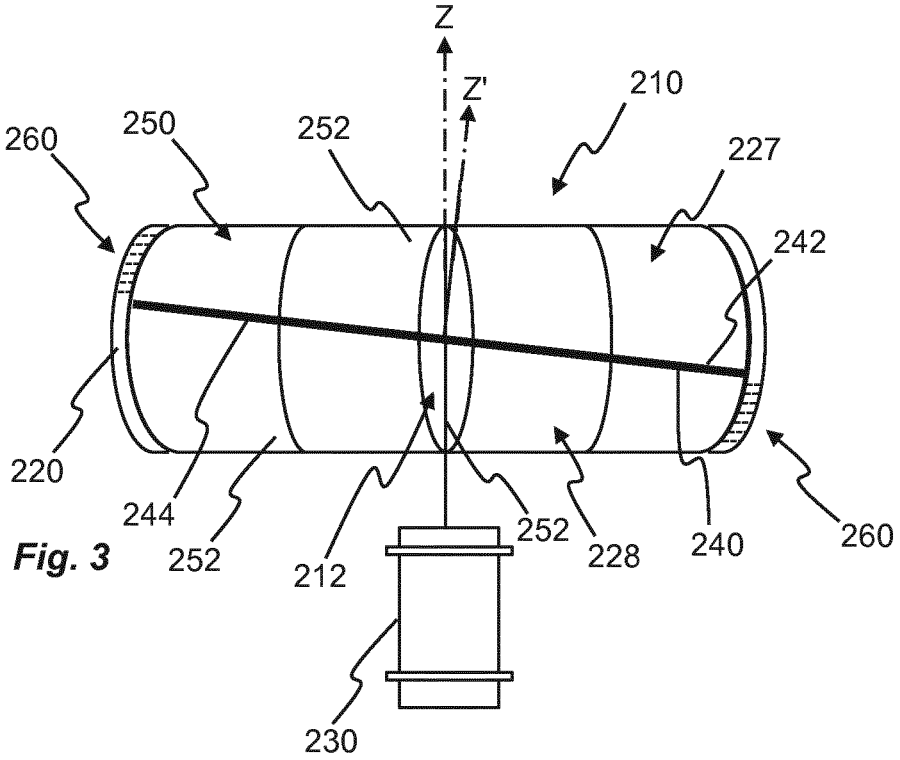
FIG. 3 is a side view of a rotor of a mixing unit for use in a liquid processing mixer.

Starting with FIGS. 2 and 3, the mixing unit 200 operates by rotating a rotor 210 within a stator 220. The stator 220 forms a hollow sleeve by means of a circumferential side wall 222. The side wall 222 has a curved shape, such that the diameter of the stator 220 varies along its longitudinal axis Z. As can be seen in FIG. 2 the stator 220 has an upper end 224 and a lower end 226. The inner diameter of the upper end 224 equals the inner diameter of the lower end 226. Starting at the upper end 224, the inner diameter continuously increases towards the center of the stator 220, such that the maximum inner diameter of the stator 220 is provided at a center position 225 arranged at equal distance from the upper end 224 and the lower end 226.

The rotor 210 is further shown in FIG. 3. The rotor 210 is driven by an electrical motor 230 such that the rotor 210 may rotate within the stator 220.

The rotor 210 is configured to rotate around the longitudinal axis Z of the stator 220, and includes a displacement plate 240 which is tilted relative the longitudinal axis Z such that a normal direction Z' of the displacement plate 240 is angled relative the longitudinal axis Z. The displacement plate 240 extends radially within the stator 220 such that the displacement plate 240, having a circular shape, divides the space inside the stator 220 into an upper partition 227 and a lower partition 228. Preferably, the size of the displacement plate 240 is chosen such that the displacement plate 240 leaves a small gap at the inner surface of the side wall 222 of the stator 220. The small gap is dimensioned such that no liquid product may escape, still providing a low friction between the displacement plate 240 and the inner surface of the side wall 222. The volume of the upper partition 227 equals the volume of the lower partition 228, such that these volumes are constant throughout rotation of the rotor 210 and the displacement plate 240.

In one embodiment an electrical motor 230 is arranged to drive the rotor 210 for rotation around the longitudinal axis Z, such that the displacement plate 240 as well as the vane assembly 250 are rotating. In other embodiments two different electrical motors will be arranged to drive the displacement plate 240 and the vane assembly 250, respectively. Hence, there will be no torque transfer between the displacement plate 240 and the vane assembly 250 since the rotation of these two components is provided by means of two separate driving units. In a yet further embodiment, one electrical motor is arranged to provide a first rotation to the displacement plate 240, and a second rotation to the vane assembly 250. For this, the electrical motor may be connected to a transmission whereby the first and second rotations are synchronized.

The rotor 210 further includes a vane assembly 250 having a plurality of vanes 252. Each vane 252 extends radially outwards from a center hub 212 of the rotor 210 and ends adjacent to the inner surface of the side wall 222 of the stator 220. Hence, a small gap is formed between the radial ends of the vane assembly 250 and the inner surface of the side wall 222. The small gap ensures a very low friction between the vane assembly 250 and the inner surface of the side wall 222, and is dimensioned such that liquid leakage is prevented. The vanes 252 are spaced apart by an equal angular distance. As is shown in FIGS. 2 and 3, eight vanes 252 are provided at a distance of 45° from each other. The vanes 252 are extending between the upper end 224 and the lower end 226 of the stator 220 and run through slits (not shown) in the displacement plate 240.

Two adjacent vanes 252 will form a chamber 214 together with the displacement plate 240 and the side wall 222 of the stator 220. As is shown especially in FIG. 2 eight chambers 214 will be formed on the upper side 242 of the displacement plate 240, and eight corresponding chambers 214 will be formed on the lower side 244 of the displacement plate 240.

Since the displacement plate 240 is tilted the volume of the chambers 214 will vary. As is clearly shown in FIG. 3, a small volume chamber is formed at the upper side 242 of the displacement plate 240 at the left in the figure. To the right in the figure, i.e. at a distance of 180° from the small volume chamber, a large volume chamber is formed on the upper side 242 of the displacement plate 240. The volume of the large volume chamber will decrease continuously as the rotor 210 rotates such that the minimum volume is obtained at the left in the figure. Consequently, the volume of the small volume chamber will increase continuously as the rotor 210 rotates such that the maximum volume is obtained at the right in the figure. During rotation of the rotor, the volume of the chambers will thus vary according to a periodic pattern, wherein one revolution will represent a cycle.

The same configuration of chambers 214 are formed on the lower side 244 of the displacement plate 240, although the volume of the chambers are phase shifted by 180° compared to the chambers of the upper side 242 of the displacement plate 240.

The displacement plate 240 is thus allowed to slide relative the vanes 252 along the direction of the longitudinal axis Z such that the volume of the chambers 214 may change upon rotation.

From above, a liquid product which enters the space within the stator 220 by filling up the volume of a large volume chamber 214 will be compressed during rotation of the rotor 210 as the volume of the chamber 214 decreases. In order to allow the liquid product to escape out from the space within the stator 220 an area 260 which is provided with at least one through hole is provided on the side wall 222 of the stator 220. The area 260 is arranged at an angular position corresponding to the position where the small volume chamber 214 occurs. For the chambers 214 formed on the upper side 242 of the displacement plate 240, the outlet area 260 is provided between the upper end 224 of the stator and the displacement plate 240.

As can be seen in FIGS. 2 and 3, a further exit area 260 is provided for allowing liquid product to exit the chambers formed with the lower side 244 of the displacement plate 240. The exit areas 260 are arranged at a distance of 180° from each other, wherein each exit area 260 is aligned with a specific rotational position of the displacement plate 240 such that a chamber 214 having a minimum volume will be in connection with the exit area 260.

Each exit area 260 preferably comprises a plurality of through holes. The through holes are small, e.g. having a diameter in the range of 1-5 mm, and they are distributed in separate rows having different lengths. As shown in FIG. 2, the through holes are distributed in four rows, wherein the length of the rows are decreasing towards the upper and lower ends of the stator 220. However, the openings formed by the through holes at the respective exit area 260 may be distributed in various patterns.

The exit areas 260 may be designed according to user preferences. Should the exit areas 260 be formed by one or few large through holes the pumping capacity will be very high although the mixing performance will be reduced. By reducing the size of the through holes the mixing performance is increased, although the pumping capacity is decreased. Hence, it is possible to construct the mixing unit 200 in a vast amount of different ways in order to provide a suitable relationship between the pumping capacity and the mixing capacity.

Figure 4:
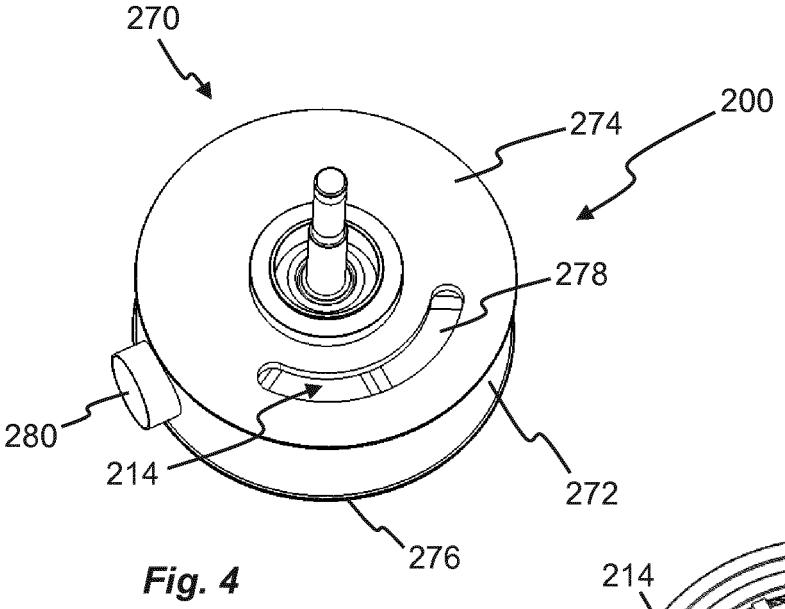
FIG. 4 is a perspective view of a mixing unit for use in a liquid processing mixer according to an embodiment.
Figure 5:
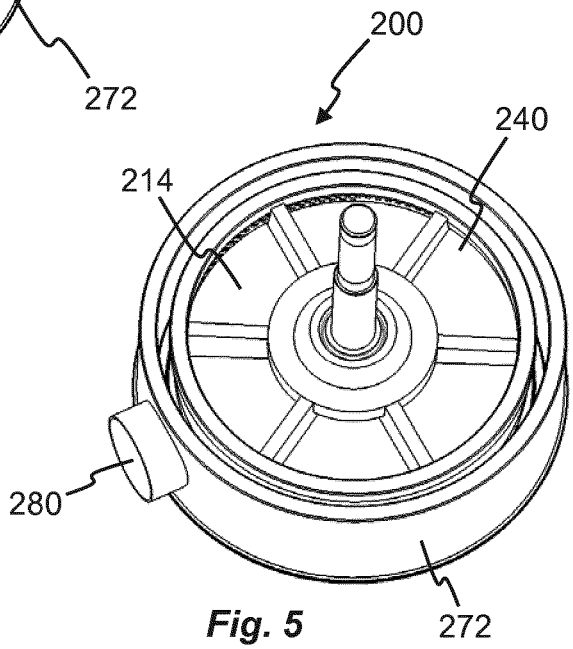
FIGS. 5 and 6 are perspective views of a stator and a rotor of a mixing unit according to an embodiment.
Figure 6:
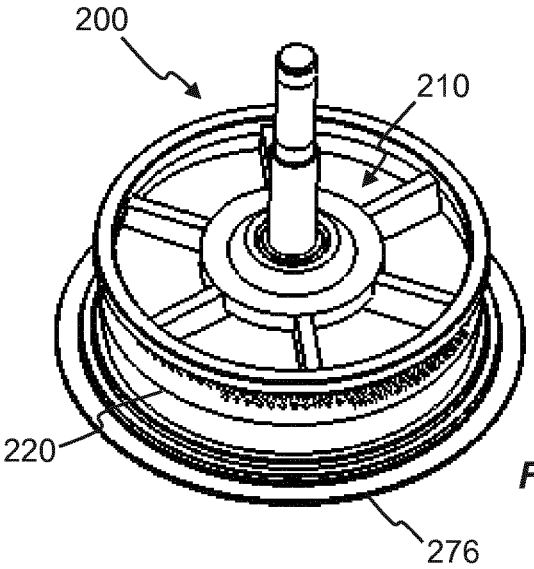

The mixing unit 200 is further shown in FIGS. 4-6. The stator 220 is housed inside an enclosure 270. The enclosure 270 comprises an outer support structure 272 which surrounds the stator 220, and two opposite lids 274, 276 for closing the open ends of the outer support structure 272 and consequently also closing the chambers. As is shown in FIG. 4, the upper lid 274 has an inlet 278 which is configured to be connected to a fluid line (not shown). Hence, the inlet 278 forms an opening in the upper lid 274 such that liquid product may flow into the chambers 214 formed by the rotor 210. The inlet 278 is positioned such that it faces the chambers 214 being subjected to a volume increase, i.e. in an angular positioned being arranged approximately 180° from the associated exit area 260.

The outer support structure 272 comprises an outlet 280 which serves to allow fluid to exit the mixing unit 200. Hence, the outlet 280 is configured to be connected to a fluid line (not shown).

As is further shown in FIG. 5 the liquid product which is forced to move out from the exit area 260 will fill the space formed between the stator 220 and the outer support structure 272. As the space is filled with mixed liquid product, the liquid product will be allowed to escape out from the mixing unit 200 at an increased pressure, which pressure increase is provided by the mixing unit 200.

The mixing unit 200 may be operated in a serial mode, or in a parallel mode. In a serial mode operation the outer support structure 272 is divided into two symmetrical compartments, wherein a first compartment is in fluid communication with the exit area 260 being associated with the upper side of the displacement plate 240. The second compartment, being sealed off from the first compartment, is in fluid communication with the exit area 260 being associated with the lower side of the displacement plate 240. Each compartment has an outlet for discharging mixed liquid. Further, an inlet is provided on the upper lid as well as on the lower lid. Since the mixing unit according to this embodiment has two inlets and two outlets, the mixing unit may be operated such that an outlet, being associated with one of the compartments, is connected to the inlet being associated with the other compartment. In such case the mixing performance of the mixing unit is increased due to the fact the liquid will be mixed in two subsequent steps, although the volume capacity of the mixing unit will be reduced.

In another embodiment, unmixed liquid will enter the chambers formed on the upper side of the displacement plate as well as the lower side of the displacement plate for providing parallel mixing. Hence, unmixed liquid is fed to the inlets on the upper lid and the lower lid simultaneously. The outer support structure 272 may either house only compartment, such that mixed liquid exiting the stator will be discharged through a single outlet. In another embodiment, parallel mixing may be accomplished also if the outer support structure 272 forms two separate compartments, each compartment having an associated outlet. In such case mixed liquid will be discharged through the respective outlet, whereby the mixed liquid may be recombined in a common liquid conduit downstream of the mixing unit 200.

The mixing unit 200 is preferably able to pump/circulate both low and high-viscous products, e.g. in the range of 1-100000 cP. Due to the construction of the mixing unit 200, the mixing unit 200 is capable of providing a sub-pressure on the inlet side, i.e. upstream of the mixing unit 200, as well as being capable of providing an increased pressure on the outlet side, i.e. downstream of the mixing unit 200.

The mixing unit 200 is further capable of creating high levels of shear and turbulence and thus to disperse, emulsify and/or dissolve incorporated liquid and powder ingredients. In accordance with the description above, the mixing unit 200 operates according to the rotor/stator mixer principle. The different velocities of the liquid product in the chambers 214 will create shear, as the liquid product at the outer end of the chambers 214 will travel faster than the liquid product at the inner radius of the chambers 214. Further, the small gaps formed by the through holes in the exit areas 260 will form a high shear zone as the liquid product is forced to exit through these holes.

The presented mixing unit 200 eliminates the need for a separate vacuum pump. This fully removes the risk of foam overrun through the vacuum system caused by bubble and foam growth in case a deaeration vessel is used upstream of the mixing unit 200. Naturally such product loss is undesirable and leads to hygienic and cleaning problems. In addition to this, a de-aeration vessel connected to a vacuum pump cannot be used if the product is toxic or for other reasons cannot escape the vessel/system.

In view of above, the speed of the mixing unit can be adjusted in a wide range and is not limited by vortex and foam constraints. The only air introduced in the present mixing unit 200 is the air embedded in the ingredients. The part of the embedded air that is evacuated by the vacuum will correspondingly be accumulated in the de-aeration vessel.

Figure 7:
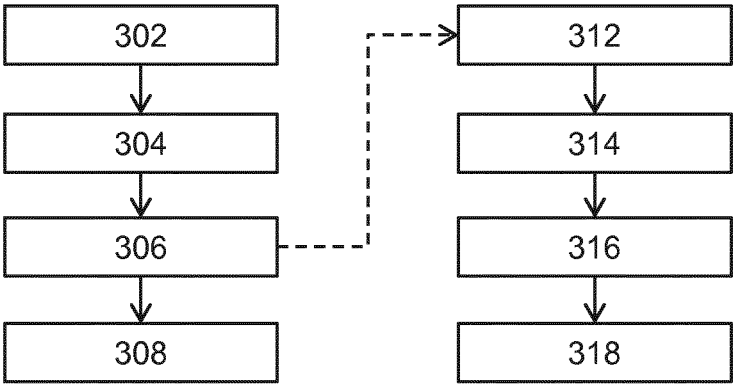
FIG. 7 is a schematic view of a method according to an embodiment.

Now turning to FIG. 7, a method 300 for mixing a liquid product will be described. Starting at step 302, liquid product is introduced into one or more chambers of a rotor, which rotor is rotating within a stator. In accordance with the description above each chamber is formed between at least two vanes extending in a direction being parallel with a longitudinal axis of the stator. A chamber is further delimited by the inner wall of the stator, the displacement plate, and a lid. The displacement plate is tilted such that a normal direction of the displacement plate is tilted relative a longitudinal axis of the stator, whereby the volume of the chambers will vary during rotation of the rotor.

In a next step 304 the rotor is rotated such that the volume of the chamber accommodating the liquid product is reduced, whereby the liquid product is compressed.

Rotation is performed such that the rotor will eventually be arranged in a position where the volume of the chamber accommodating the liquid product is at a minimum.

In step 306 the liquid product is discharged through an exit area of the stator, which exit area provides a mixing effect of the liquid product. Upon this, in step 308 the mixed liquid product is allowed to flow out from the mixing unit via an outlet being arranged in an enclosure housing the stator and rotor.

In a serial mode operation, step 306 may be followed by a step 312. In step 312 the mixed liquid product is introduced in at least one chamber being arranged on an opposite side of the displacement plate. Step 312 is thus similar to step 302, and is followed by a step 314 in which the rotor is rotated such that the volume of the chamber accommodating the liquid product is reduced, as well as step 316 in which the liquid product is discharged through an exit area of the stator. Step 314 corresponds to step 304, while step 316 correspond to step 306. Step 316 may be followed by a step 318, in which the mixed liquid product is allowed to flow out from the mixing unit.

Although the above description has been made mostly with reference to a liquid food processing system, it should be readily understood that the general principle of the mixer is applicable for various different liquid processing systems.

Further, the invention has mainly been described with reference to a few embodiments. However, as is readily understood by a person skilled in the art, other embodiments than the ones disclosed above are equally possible within the scope of the invention, as defined by the appended claims.

The invention claimed is:

1. A mixing unit for mixing a flow of liquid product, comprising:

a stator forming a hollow sleeve, and a rotor having a circular displacement plate with two opposite sides, wherein at least one side has at least two chambers formed by a plurality of vanes extending in a direction parallel with a longitudinal axis of the stator, wherein the rotor is arranged within the stator for rotating liquid product in said chambers relative the stator, wherein the displacement plate is tilted relative a longitudinal axis of the stator such that a normal direction of the displacement plate is angled relative to the longitudinal axis of the stator so that said at least two chambers have different volumes, the displacement plate being slidable relative to the vanes along the direction of the longitudinal axis such that a volume of each of the at least two chambers changes upon rotation of the rotor, and a side wall of the stator has at least one exit area comprising at least one through hole for allowing liquid product to exit the stator.

2. The mixing unit according to claim 1, further comprising an electrical motor, wherein a rotational axis of the motor is connected to the rotor of the mixing unit.

3. The mixing unit according to claim 1, wherein the plurality of vanes forms a vane assembly such that each vane extends radially outwards from a centre portion of the displacement plate, such that the outer edges of the vane assembly are arranged adjacent to an inner surface of the stator for forming the chambers.

4. The mixing unit according to claim 3, wherein a single vane assembly forms the chambers on both sides of the displacement plate.

5. The mixing unit according to claim 1, wherein the volume of one of said at least two chambers increases during rotation of the rotor and the volume of an other one of said at least two chambers decreases during rotation of the rotor, and said at least one exit area is arranged at a circumferential position corresponding to a position where said other one of said at least two chambers has a decreased volume.

6. The mixing unit according to claim 1, wherein each one of said opposite sides of the displacement plate has at least two chambers formed by a plurality of vanes.

7. The mixing unit according to claim 6, further comprising an additional inlet for allowing liquid product to enter at least one of said chambers on an opposite side of the displacement plate.

8. The mixing unit according to claim 6, further comprising a first inlet for allowing liquid product to enter at least one of said chambers, a second inlet for allowing liquid product exiting the at least one chamber to enter at least one of the chambers on an opposite side of the displacement plate, and an outlet for allowing liquid product to exit said mixing unit.

9. The mixing unit according to claim 1, further comprising an inlet for allowing liquid product to enter at least one of said chambers, and an outlet for allowing liquid product to exit said mixing unit, wherein said inlet is arranged at a circumferential position corresponding to a position where the chambers have an increasing volume.

10. The mixing unit according to claim 1, wherein both sides of the circular displacement plate includes a plurality of the separated chambers and a plurality of the vanes, the chambers on each side of the circular displacement plate being defined by circumferentially adjacent ones of the vanes and the inner surface of the side wall of the stator.

* * * * *